US005806508A

United States Patent [19]

Stempien et al.

[11] Patent Number: 5,806,508

[45] Date of Patent: Sep. 15, 1998

[54] ARCHERY BOW HOLDER

[76] Inventors: Mary Ann Stempien, 2779 Murmer; James Otto Grenke, 526 Barnyard Blvd., both of Gaylord, Mich. 49735

[21] Appl. No.: 826,948

[22] Filed: Apr. 8, 1997

[51] Int. Cl.[6] ..... F41B 5/14

[52] U.S. Cl. ..... 124/86; 248/156; 248/176.3; 248/328; 248/693

[58] Field of Search ..... 248/156, 157, 248/176.3, 216.1, 317, 332, 328, 419, 530, 690, 693; 124/1, 23.1, 86

[56] References Cited

U.S. PATENT DOCUMENTS

| | | | |
|---|---|---|---|
| 338,920 | 3/1886 | Brady | 248/332 |
| 990,346 | 4/1911 | Dreyer | 248/328 X |
| 1,375,270 | 4/1921 | Anderson | 248/328 |
| 1,722,402 | 7/1929 | Veilleux | 248/216.1 X |
| 2,593,789 | 4/1952 | Pearson . | |
| 2,833,505 | 5/1958 | Dulle | 248/332 X |
| 3,441,241 | 4/1969 | Brooks . | |
| 3,991,780 | 11/1976 | Maroski, Jr. . | |
| 4,103,807 | 8/1978 | Lyon et al. | 124/23.1 X |
| 4,493,121 | 1/1985 | Williams | 248/328 X |
| 4,628,893 | 12/1986 | Shaw, III . | |
| 4,697,669 | 10/1987 | Bergsten | 248/216.1 X |
| 4,889,307 | 12/1989 | Klansek | 248/690 |
| 5,341,792 | 8/1994 | Pucillo | 124/89 |
| 5,366,098 | 11/1994 | Henry . | |

OTHER PUBLICATIONS

Swinger Bow Caddy, $16.99.

Redi–Reach, Klawhorn Industries, Bay Village, Ohio.

The Quiver Limb Bow Hanger, EZ Hunter Enterprise, Evansville, Indiana.

*Primary Examiner*—John A. Ricci

*Attorney, Agent, or Firm*—Brooks & Kushman P.C.

[57] ABSTRACT

A bow holder for holding an archery bow in a ready position is provided. The bow holder includes a vertical member and a horizontal member. The vertical member is mountable to a structure such as a tree. The horizontal member has a proximal end and a distal end. The proximal end is spaced transversely from the distal end so that the distal end extends away from the vertical member at a given distance. The bow holder further includes a string movably securable to the distal end and extending downwardly from the distal end. The string has a support portion comprising a knot. The knot is engageable with the archery bow to hold the archery bow in a ready position. The string supports the weight of the archery bow as a bow hunter aims the archery bow at a target. The knot silently releases engagement from the archery bow as the bow hunter draws back on the archery bow to fire a shot at the target.

21 Claims, 4 Drawing Sheets

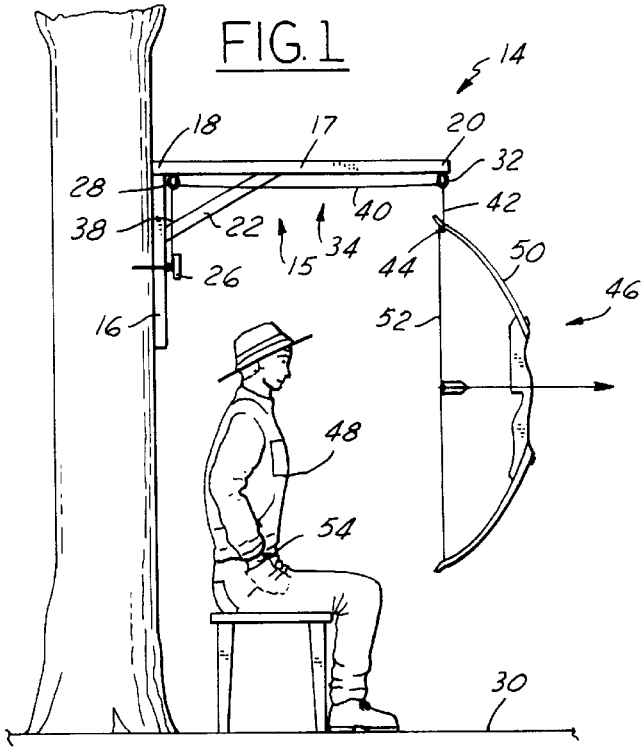
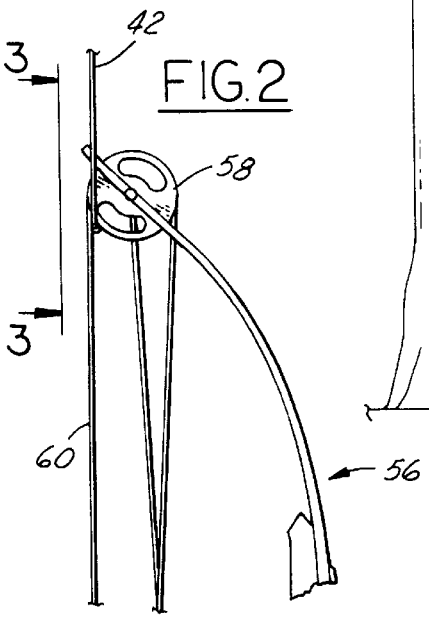
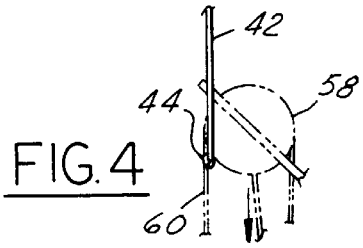
FIG. 4
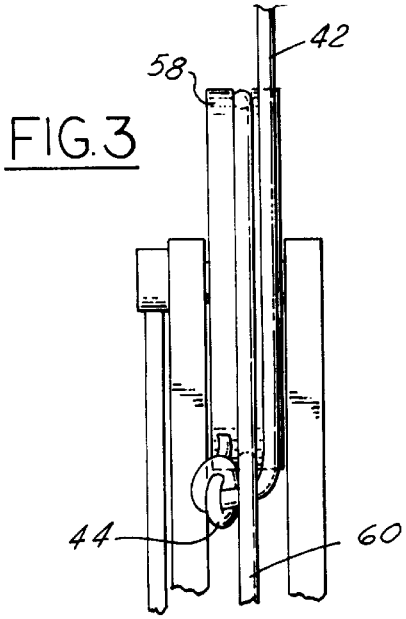
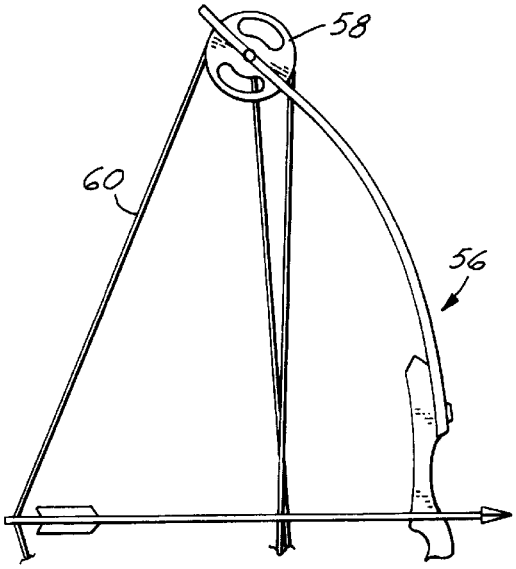

ARCHERY BOW HOLDER

TECHNICAL FIELD

The present invention relates to archery bows and, more particularly, to an archery bow holder for holding an archery bow in a ready position.

BACKGROUND ART

Archery is a sport enjoyed by millions. Archery consists of either target shooting or 'bow-hunting' of game. In bowhunting, it is imperative that a bow hunter properly aim and fire an archery bow without generating scuffling noises that frighten off the game. However, during bowhunting, the bow hunter sits idle for long periods of time in the wilderness waiting for an encounter with an animal. Ordinarily, the bow hunter finds it necessary during the idle periods to place his bow against a tree or shrub, in a hunting stand, on a tree stand, or flat on the ground. A primary disadvantage associated with setting the bow down is that picking up the bow and nocking an arrow on a bow cord of the bow upon the appearance of an animal takes too much time and causes noises which frighten off the animal.

The alternative to placing the bow aside is to constantly hold it while waiting for game. A primary disadvantage associated with constantly holding the bow is that the hands of the hunter may become fatigued. Fatigue may cause the bow hunter to improperly fire the bow upon the appearance of game. Furthermore, in foul weather such as snow, rain, sleet, etc., the hands of the hunter may become extremely cold and wet which may also cause the bow hunter to improperly fire the bow. Additionally, the bow hunter may generate noises when moving the bow from the held position to an aiming position. It is also usual for the bow hunter who continuously holds the bow to keep an arrow nocked on the bow cord. Because the bow hunter needs to move the bow to an aiming position upon the appearance of an animal, the movement of the bow hunter may cause the arrow to fall from its nocked position. As a result, the bow hunter needs more time and generates more movement to renock the arrow.

U.S. Pat. No. 3,441,241 discloses a bow holder for supporting an archery bow in a ready position. The bow holder of the '241 patent is a collapsible bow holder having a vertical member for insertion into the ground and a rotatable member. The rotatable member is movable around an arc around the vertical member to create multiple positions for receiving a bow frictionally engaged against the vertical and rotatable members. Upon the appearance of game, the bow hunter withdrawals the bow causing the rotatable member to fall to the ground. The rotatable member has a rubber stopper to prevent noises as it strikes the ground. A primary disadvantage associated with the bow holder of the '241 patent is that the bow must be lifted and supported solely by the bow hunter while aiming. The bow holder disclosed in the '241 patent does not assist in supporting the weight of the archery bow while the bow hunter is aiming. Furthermore, the bow holder of the '241 patent is a rather complex device and it is dubious that the rotatable member does not cause any noise which may frighten off an animal as it strikes the ground.

U.S. Pat. Nos. 5,341,792, 4,889,307, and 4,628,893 disclose hangers for hanging an archery bow on a tree limb. These hangers also suffer the same disadvantage as the bow holder of the '241 patent. Namely, the bow must be lifted off of the hangers and supported solely by the bow hunter while aiming.

SUMMARY OF THE INVENTION

Accordingly, it is an object of the present invention to provide a bow holder for holding an archery bow in a ready position, for supporting the bow while a bow hunter aims the bow, and for silently being released from the bow as the bow hunter draws back on the bow to fire a shot.

It is a further object of the present invention to provide a bow holder for holding an archery bow in a ready position to enable a bow hunter to protect his hands from foul weather and fatigue while waiting for game.

It is another object of the present invention to provide a bow holder for holding an archery bow in a ready position to eliminate damage to the bow caused by placing it on the ground or against a tree.

It is still a further object of the present invention to provide a bow holder for holding an archery bow in a ready position with an arrow nocked on the bow cord of the bow while the bow hunter waits for game.

It is still another object of the present invention to provide a bow holder which is portable.

It is still yet a further object of the present invention to provide a bow holder which assists in lifting an archery bow from a lower level up to an upper level.

It is still yet another object of the present invention to provide a bow holder for holding either a compound bow or a straight bow in a ready position.

In carrying out the above objects, the present invention provides a bow holder for holding an archery bow in a ready position. The bow holder includes an L-shaped member. The L-shaped member consists of a vertical member and a horizontal member. The horizontal member has a proximal end and a distal end. The proximal end is spaced transversely from the distal end so that the distal end extends away from the vertical member at a given distance.

The bow holder also includes a string movably securable to the distal end and extending downwardly from the distal end. The string has a support portion which is engageable with the archery bow to hold the archery bow in a ready position. The support portion supports the weight of the archery bow while a bow hunter aims the archery bow at a target and then silently releases engagement from the archery bow as the bow hunter draws back on the archery bow to fire a shot at the target.

In a preferred embodiment, the vertical member is vertically adjustable to vary the height of the horizontal member. The horizontal member is horizontally adjustable so that the given distance that the distal end extends away from the vertical member may be varied. A proximal ring and a distal ring are affixed to the proximal end and the distal end respectively. A T-bar screw is associated with the vertical member.

In the preferred embodiment, the string is releasible securable at one end to the T-bar screw and extends across the horizontal member through the proximal ring and the distal ring and downwardly from the distal end at the other end. The string has a knot at the other end which is engageable with the archery bow to hold the archery bow in a ready position. The string supports the weight of the archery bow when the knot is engaged with the archery bow and the string is secured at the one end to the T-bar screw while the bow hunter aims the archery bow at the target. The knot silently releases engagement from the archery bow as the bow hunter draws back on the archery bow to fire a shot at the target.

The advantages accruing to the present invention are numerous. The bow holder holds an archery bow in a ready position with an arrow nocked to enable a bow hunter to rest and relax while waiting for game. Upon appearance of game, the bow hunter may aim the archery bow while the bow holder supports the weight of the bow. The bow holder silently releases its hold on the archery bow as the bow hunter draws back on the bow to fire a shot. In short, the bow holder provides an effective and efficient one step system in which the archery bow is automatically released and immediately ready for shooting without generating noises and without wasting valuable time and with minimal movement on the archer's part to call attention to his presence.

These and other features, aspects, and embodiments of the present invention will become better understood with regard to the following description, appended claims, and accompanying drawings.

BRIEF DESCRIPTION OF THE DRAWINGS

FIG. 1 is a perspective view of the bow holder of the present invention mounted to a tree;

FIG. 2 is a side view illustrating the string of the bow holder engaging a compound bow;

FIG. 3 is a view along the line 3—3 of FIG. 2;

FIG. 4 is a side view illustrating the string of the bow holder silently releasing from a compound bow as a bow cord is drawn back;

BEST MODES FOR CARRYING OUT THE INVENTION

Figure 5:
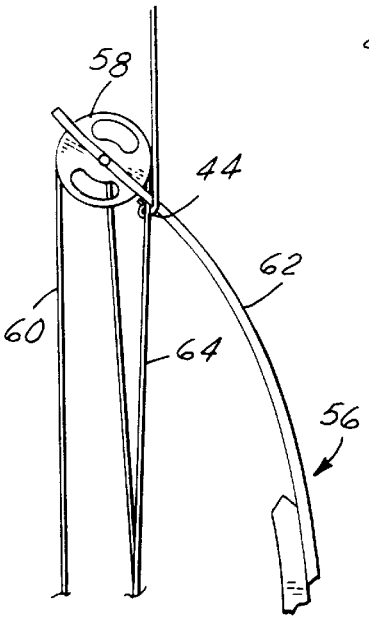
FIG. 5 is a side view illustrating the string of the bow holder engaging a compound bow in an alternative manner.

Referring now to FIG. 1, an archery bow holder 14 is shown. Bow holder 14 includes an L-shaped bracket or member 15 comprising a vertical member 16 and a horizontal member 17. Vertical member 16 has a proximal end 18 spaced transversely from a distal end Proximal end 18 is connected to vertical member 16 so that distal end 20 extends away from the vertical member at a given distance. A brace 22 connected between vertical member 16 and horizontal member 17 supports the horizontal member.

As shown in FIG. 1, vertical member 16 is mounted to a tree 24 by a T-bar screw 26. Of course, other mounting members may be used such as nails, screws, a hook and loop fastening belt, or the like for mounting vertical member 16 to tree 24. Preferably, L-shaped member 15 is made of wood or a metal such as aluminum.

A proximal ring 28 is affixed to proximal end 18 of horizontal member 17 and extends downwardly towards ground 30. Similarly, a distal ring 32 is affixed to distal end 20 of horizontal member 17 and extends downwardly towards ground 30. A string 34 is releasible securable at one end 36 to T-bar screw 26. String 34 is preferably made of a material such as nylon. String 34 has a vertical portion 38, an intermediate portion 40, and a downwardly depending portion 42. Vertical portion 38 extends from end 36 on T-bar screw 26 through proximal ring 28. Intermediate portion 40 extends across horizontal member 17 through proximal ring 28 and distal ring 32. Downwardly depending portion 42 extends downwardly to ground 30 from distal ring 32. Downwardly depending portion 42 has an end which is tied in a knot 44.

Knot 44 is engageable with a straight archery bow 46 to function as a support portion for holding the straight bow in a ready position. Specifically, knot 44 engages straight bow 46 between curved limb 50 and bow cord 52. String 34 supports the weight of straight bow 46 when knot 44 is engaged with the straight bow to enable a bow hunter 48 to aim the bow at a target. As will be described in further detail below, knot 44 silently releases engagement from curved limb 50 and bow cord 52 as bow hunter 48 draws back on the bow cord to fire a shot at the target. As shown in FIG. 1, an arrow 54 is nocked in straight bow 46 into the ready position so that bow hunter 48 may quickly and quietly use the straight bow upon the appearance of a target. Further shown in FIG. 1, with the use of bow holder 14, bow hunter 48 may keep his hands 54 warm and dry and rest them while waiting for a target. As a result, hands 54 of bow hunter 48 are not fatigued or numb from holding straight bow 46 while waiting for game in foul weather.

Referring now to FIGS. 2, 3, and 4, knot 44 is also engageable with a compound archery bow 56 to hold the compound bow in a ready position. Specifically, knot 44 engages compound bow 56 between cam or pulley 58 and bow cord 60. As shown best in FIG. 4, knot 44 silently releases engagement from pulley 58 and bow cord 60 as the bow cord is drawn back.

As shown in FIG. 5, knot 44 may engage compound bow 56 between curved limb 62 and bow cord 64 in front of pulley 58. Upon drawing back bow cord 64, knot 44 silently releases engagement with compound bow 56.

Figure 6:
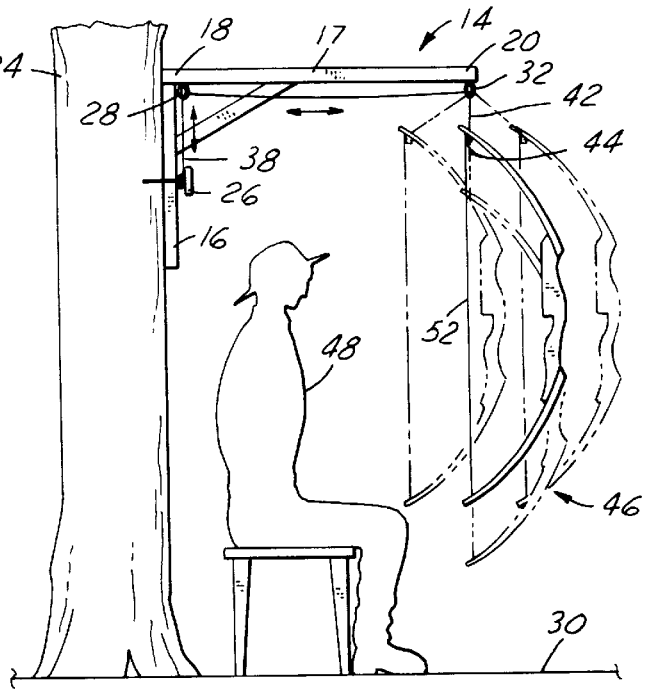
FIG. 6 is a side view illustrating horizontal adjustability of the horizontal member of the bow holder to vary the horizontal position of an archery bow while aiming.

Referring now to FIG. 6, bow holder 14 enables the lateral or horizontal position of an archery bow such as straight bow 46 to be varied by bow hunter 48 while aiming the straight bow. By being able to laterally vary the position of straight bow 46 while aiming at a target, bow hunter 48 may obtain a comfortable shooting position. As shown in FIG. 6, string 34 supports the weight of straight bow 46 when knot 44 is engaged with the straight bow to allow bow hunter 48 to laterally position and aim the straight bow with ease.

Figure 7:
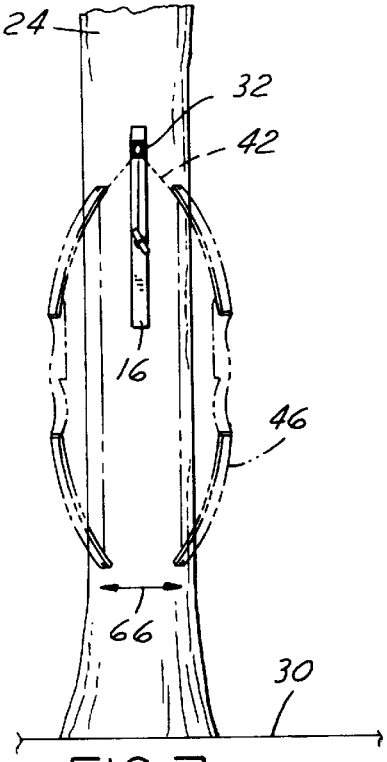
FIG. 7 is a front view illustrating the bow holder holding an archery bow while allowing the bow to be aimed around an arc.

Looking now at FIG. 7 with FIG. 6 in mind, bow holder 14 also enables the arcuate position of an archery bow such as straight bow 46 to be varied by bow hunter 48 while aiming the straight bow. Specifically, bow hunter 48 may position straight bow 46 around an arc 66 to aim the straight bow. As shown in FIG. 7, string 40 supports the weight of straight bow 46 while bow hunter 48 arcuately positions and aims the straight bow. During the aiming process, the weight of straight bow 46 is carried by bow holder 14. As a result, bow hunter 48 can simply nudge and point straight bow 46 at a target without supporting the weight of the straight bow during the aiming process.

When the aiming process is completed, bow hunter 48 simply pulls back on bow cord 52 and knot 44 releases from the straight bow. At this point, bow hunter 48 carries all of the weight of straight bow 46. However, because bow holder 14 supported the weight of straight bow 46 during the aiming process, bow hunter 48 is not fatigued and should be able to support the straight bow and fire off an accurate shot.

Figure 8:
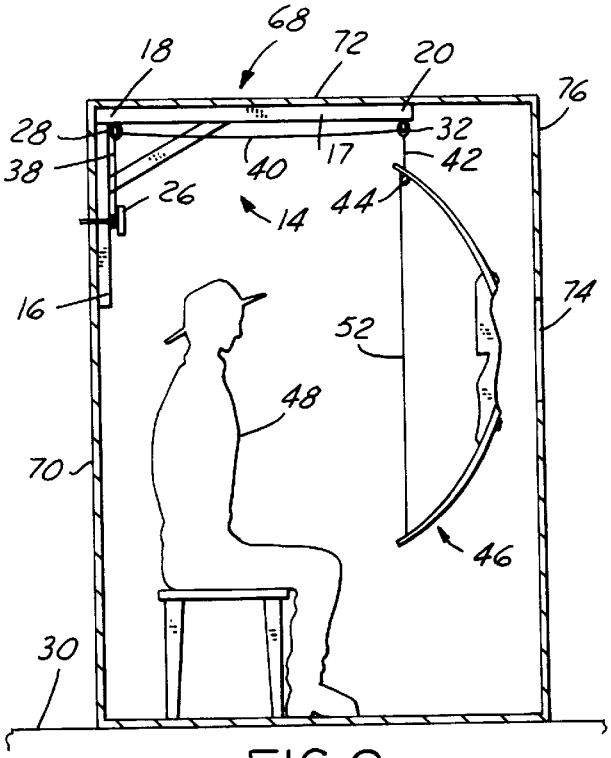
FIG. 8 is a side view of the bow holder mounted to a hunting box.

Turning now to FIG. 8, bow holder 14 is also useable with a hunting box 68 of bow hunter 48. In this environment, vertical member 16 is mounted to a back side door 70 of hunting box 68 by T-bar screw 26. Horizontal member 17 may also be mounted to ceiling 72 of hunting box 68 for additional support. An arrow from straight bow 46 may be fired through a shoot through opening 74 on front side 76 of hunting box 68.

Figure 9:
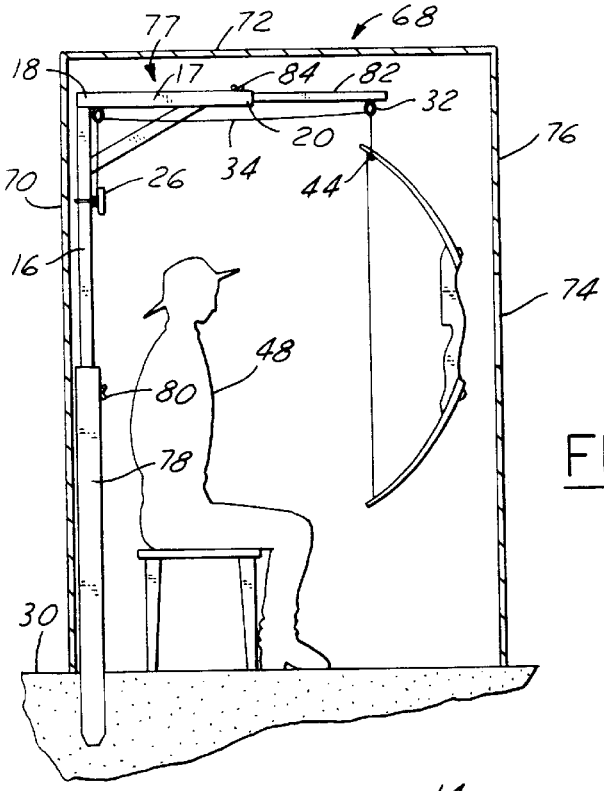
FIG. 9 is a side view of the bow holder mounted into the ground inside a hunting box.

In an alternative embodiment shown in FIG. 9, a bow holder 77 includes a mounting member 78 which mounts into ground 30. Vertical member 16 is vertically slidable within mounting member 78. A washer assembly 80 is adjustable to lock vertical member 16 at a given vertical position. Bow holder 77 further includes a telescoping extending member 82. Extending member 82 is horizontally slidable within horizontal member 17. A washer assembly 84 is adjustable to lock extending member 82 at a given horizontal position. With the use of mounting member 78 and extending member 82, the vertical and horizontal positions of an archery bow held by bow holder 14 in the ready position may be adjusted to custom fit bow hunter 48.

Figure 10:
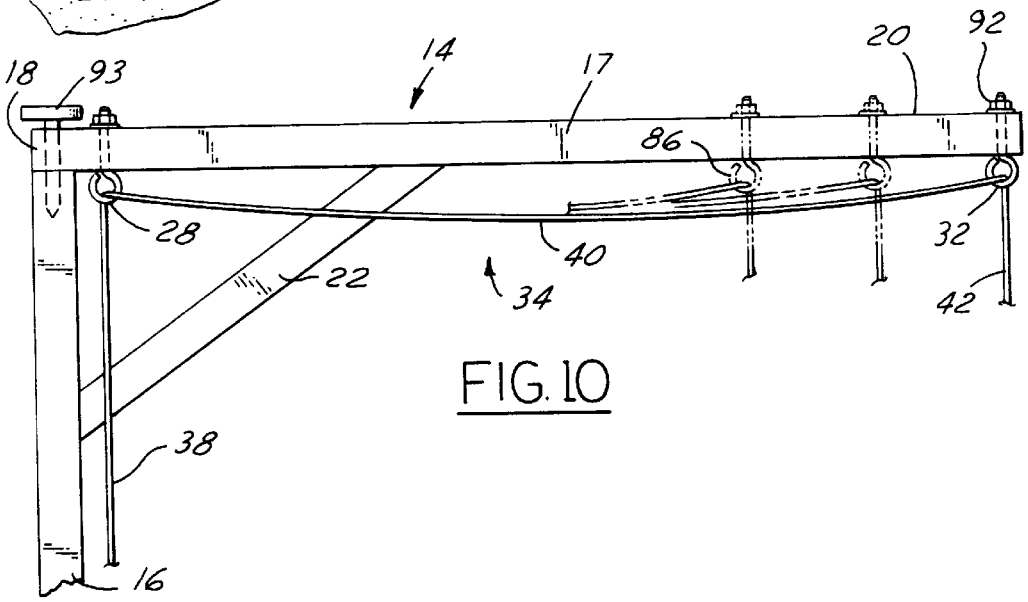
FIG. 10 is a side view illustrating rings affixed to the distal end of the horizontal member of the bow holder to adjust the horizontal position of an archery bow.
Figure 11:
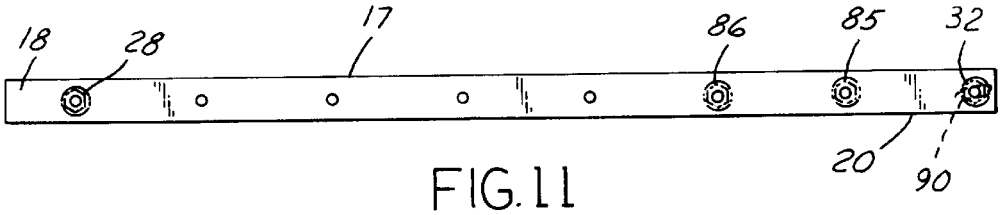
FIG. 11 is a top view of the horizontal member shown in FIG. 10.

Referring now to FIGS. 10 and 11, horizontal member 17 may be provided with additional rings 85 and 86 spaced at various locations along the horizontal member. Each ring has a elongated portion 88 which extends through an aperture 90 (shown best in FIG. 11) in horizontal member 17. A nut assembly 92 locks in elongated portion 88. Downwardly depending portion 42 of string 34 may be placed to extend through any of the rings to vary the horizontal position of an archery bow held in the ready position. With the use of the additional rings, the horizontal position of an archery bow held by bow holder 14 in the ready position may be adjusted to custom fit bow hunter 48.

As shown in FIG. 10, a T-bar screw 93 may be employed to mount proximal end 18 of horizontal member 17 to vertical member 16. The use of T-bar screw 93 supplements the support provided by brace 22.

Figure 12:
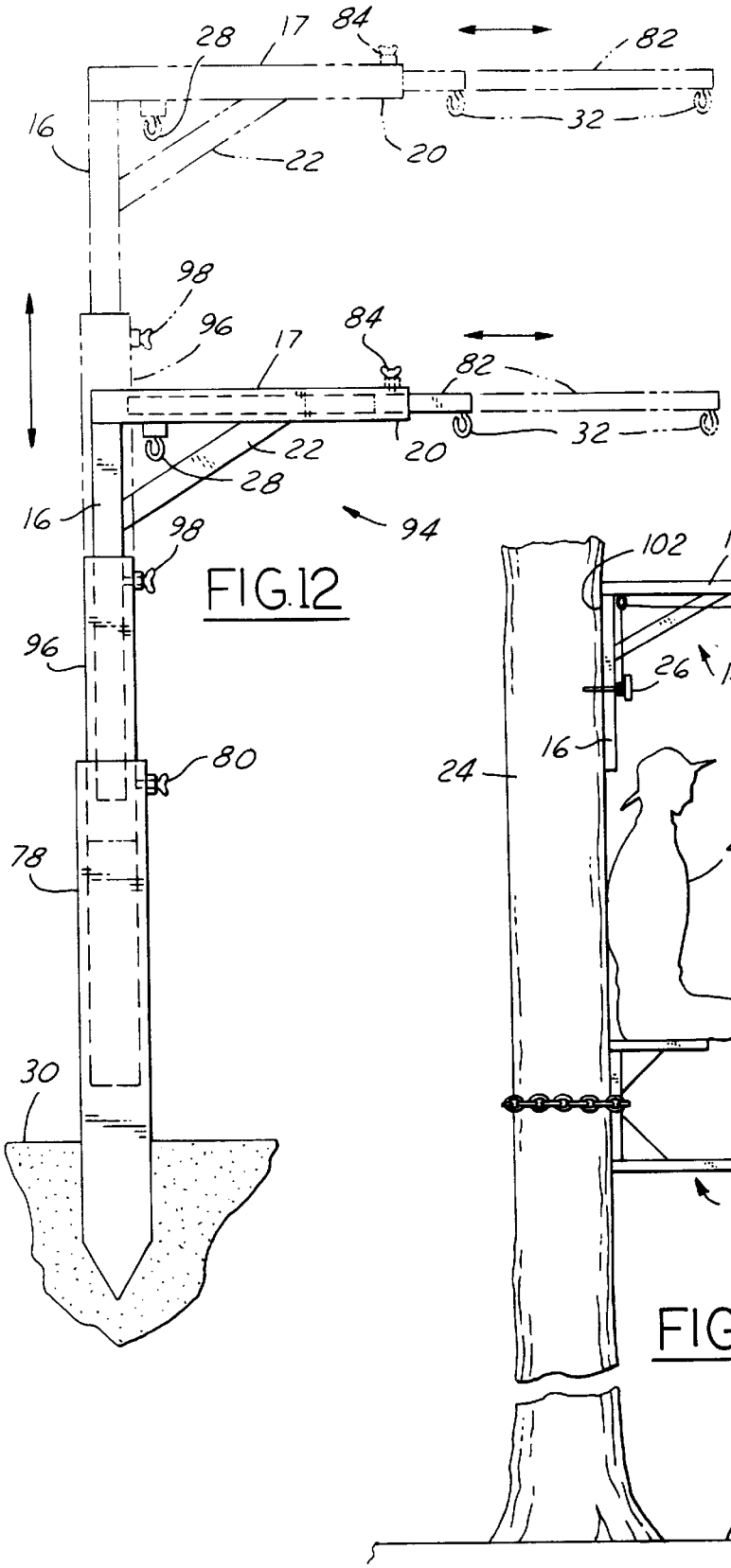
FIG. 12 is a side view illustrating the vertical adjustability of the vertical member and the horizontal adjustability of the horizontal member of the bow holder.

With continuing reference to FIG. 9, FIG. 12 shows another alternative embodiment of a bow holder 94. In addition to mounting portion 74, bow holder 94 includes an intermediate vertical member 96. Intermediate vertical member 96 is vertically slidable within mounting portion 78. Washer assembly 80 is adjustable to lock intermediate vertical member 16 at a given vertical position. Vertical member 16 is vertically slidable within intermediate vertical member 96. A washer assembly 98 is adjustable to lock vertical member 16 at a given vertical position. With the use of mounting member 78, intermediate vertical member 96 and extending member 82, the vertical and horizontal positions of an archery bow held by bow holder 14 in the ready position may be adjusted.

Figure 13:
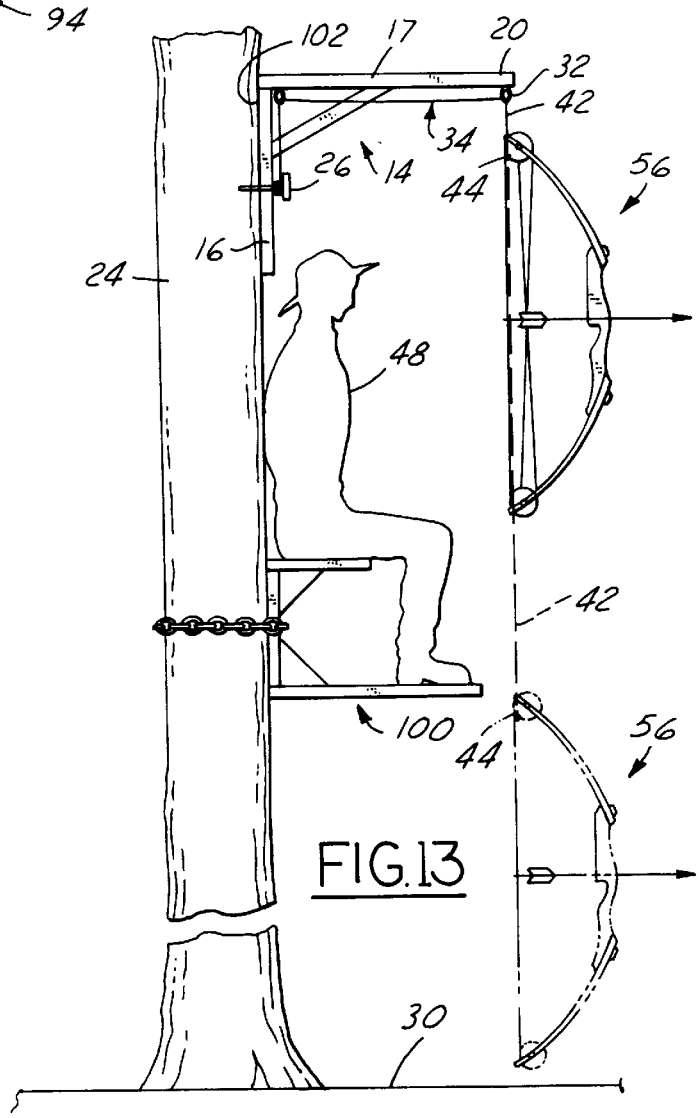
FIG. 13 is a perspective view illustrating the bow holder assisting in hoisting an archery bow from the ground up to a tree stand.

Bow holder 14 is also useable to hoist an archery bow from a lower level such as the ground up to a higher level such as a tree stand. As shown in FIG. 13, bow hunter 48 may climb tree 24 to sit in a tree stand 100 to watch for game. Climbing the tree may be difficult while carrying an archery bow. Accordingly, string 34 of bow holder 14 may be of sufficient length, for instance 25 feet, to lift an archery bow. Specifically, bow hunter 48 unwinds string 34 from T-bar screw 26, which functions as a spool, so that downwardly depending portion 42 is near the ground. Then hunter 48 positions knot 44 to engage compound bow 56. Next bow hunter 48 climbs up tree 24 to tree stand 100 while leaving compound bow 56 on ground 30. Upon reaching tree stand 100, bow hunter 48 may pull and wind string 34 around T-bar screw 26 so that downwardly depending portion 42 and compound bow 56 move away from ground 30 to a higher position adjacent tree stand 100. As a result, compound bow 56 is held in a ready position near tree stand 100 of bow hunter 48.

As shown in FIG. 13, bow holder 14 may also be equipped with a belt carrying device 102 clippable on the belt of bow hunter 48 to let the bow hunter to deftly move about the wilderness with the bow holder. Bow holder 14 may further be equipped with a long second string which is for use in hoisting the bow holder to a higher level.

In summary, the bow holder of the present invention holds an archery bow in a ready position and nocked with an arrow so that the bow hunter does not become fatigued by having to continuously hold the archery bow while waiting for game. Upon the appearance of game, the bow hunter may simply point the archery bow at the target while the bow holder supports the weight of the archery bow. When the target is locked in, the bow holder simply draws back the bow cord of the archery bow to shoot at the target. As the bow hunter draws back on the bow cord, the bow holder silently releases engagement with the archery bow to avoid interfering with use of the archery bow.

It should be noted that the present invention may be used in a wide variety of different constructions encompassing many alternatives, modifications, and variations which are apparent to those with ordinary skill in the art. Accordingly, the present invention is intended to embrace all such alternatives, modifications, and variations as fall within the spirit and broad scope of the appended claims.

What is claimed is:

1. A bow holder for holding an archery bow in a ready position comprising:

an L-shaped member having a vertical member and a horizontal member, the horizontal member having a proximal end and a distal end so that the distal end extends away from the vertical member at a given distance; and a string movably securable to the distal end and extending downwardly from the distal end, the string having a knot which is engageable with the archery bow to hold the archery bow in a ready position, wherein the knot supports the weight of the archery bow while a bow hunter aims the archery bow at a target and then silently releases engagement from the archery bow as the bow hunter draws back on the archery bow to fire a shot at the target.

2. The bow holder of claim 1 wherein:

the vertical member is mountable to a tree so that the distal end extends away from the tree.

3. The bow holder of claim 2 further comprising:

a T-bar screw associated with the vertical member for mounting the vertical member to a tree.

4. The bow holder of claim 1 wherein:

the vertical member is mountable in the ground.

5. The bow holder of claim 4 wherein:

the vertical member is vertically adjustable to raise and lower the height of the horizontal member from the ground.

6. The bow holder of claim 1 wherein:

the vertical member is mountable to a hunting box.

7. The bow holder of claim 1 wherein:

the horizontal member is horizontally adjustable to vary the given distance that the distal end extends away from the vertical member.

8. The bow holder of claim 1 wherein:

the support portion of the string is a knot.

9. The bow holder of claim 1 further comprising:

a ring affixed to the distal end, wherein the string is movably secured to the horizontal member and extends though the ring and downwardly from the ring.

10. The bow holder of claim 1 wherein:

the support portion is engageable with the archery bow to enable the bow hunter to hoist the archery bow from a lower level up to a higher level.

11. The bow holder of claim 1 further comprising:

a belt carrying device connected to the L-shaped member to enable the bow hunter to carry the bow holder.

12. The bow holder of claim 1 further comprising:

a spool affixed to the L-shaped member, wherein the string is attached to the spool to be winded and unwinded.

13. A bow holder for holding an archery bow in a ready position while enabling a bow hunter to protect his hands from foul weather so that the bow hunter is physically capable of effectively firing the archery bow upon the appearance of a target, the bow holder comprising:

a vertical member mountable to a structure;

a horizontal member having a proximal end and a distal end, the proximal end spaced transversely from the distal end so that the distal end extends away from the vertical member at a given distance;

a ring affixed to the distal end; and a string movably securable to the horizontal member and extending through the ring and downwardly from the distal end, the string having a knot which is engageable with the archery bow to hold the archery bow in a ready position, wherein the string supports the weight of the archery bow when the knot is engaged with the archery bow while the bow hunter aims the archery bow at the target and the knot silently releases engagement from the archery bow as the hunter draws back on the archery bow to fire a shot at the target.

14. The bow holder of claim 13 wherein:

the archery bow is a compound bow having a pulley and a bow cord, wherein the knot engages the compound bow between the pulley and the bow cord to hold the compound bow in the ready position.

15. The bow holder of claim 13 wherein:

the archery bow is a straight bow having a curved limb and a bow cord, wherein knot engages the straight bow between the curved limb and the bow cord to hold the straight bow in the ready position.

16. A bow holder for holding an archery bow in a ready position while enabling a bow hunter to protect his hands from foul weather and fatigue so that the bow hunter is physically capable of effectively firing the archery bow upon the appearance of a target, the bow holder comprising:

a vertical member mountable to a structure, the vertical member being vertically adjustable;

a horizontal member having a proximal end and a distal end, the horizontal member is horizontally adjustable so that the proximal end is spaced transversely from the distal end at a given distance;

a proximal ring affixed to the proximal end;

a distal ring affixed to the distal end;

a T-bar screw associated with the vertical member; and a string releasably securable at one end to the T-bar screw and extending across the horizontal member through the proximal ring and the distal ring and downwardly from the distal end at the other end, the string having a knot at the other end which is engageable with the archery bow to hold the archery bow in a ready position, the string supports the weight of the archery bow when the knot is engaged with the archery bow and the string is secured at the one end to the T-bar screw while the bow hunter aims the archery bow at the target, wherein the knot silently releases engagement from the archery bow as the bow hunter draws back on the archery bow to fire a shot at the target.

17. The bow holder of claim 16 wherein:

the string comprises nylon.

18. The bow holder of claim 16 wherein:

the horizontal and vertical members comprise aluminum.

19. The bow holder of claim 16 wherein:

the archery bow is nocked with an arrow while held in the ready position.

20. A bow holder for holding an archery bow in a ready position comprising:

a horizontal member having a proximal end and a distal end; and a string movably securable to the distal end and extending downwardly from the distal end, the string having a knot which is engageable with the archery bow to hold the archery bow in a ready position, wherein the knot supports the weight of the archery bow while a bow hunter aims the archery bow at a target and then silently releases engagement from the archery bow as the bow hunter draws back on the archery bow to fire a shot at the target.

21. A bow holder for holding an archery bow in a ready position while enabling a bow hunter to protect his hands from foul weather so that the bow hunter is physically capable of effectively firing the archery bow upon the appearance of a target, the bow holder comprising:

a horizontal member having a proximal end mountable to a structure and a distal end;

a ring affixed to the distal end; and a string movably securable to the horizontal member and extending through the ring and downwardly from the distal end, the string having a knot which is engageable with the archery bow to hold the archery bow in a ready position, wherein the string supports the weight of the archery bow when the knot is engaged with the archery bow while the bow hunter aims the archery bow at the target and the knot silently releases engagement from the archery bow as the hunter draws back on the archery bow to fire a shot at the target.

* * * * *